US007627916B1

(12) United States Patent
Gielow

(10) Patent No.: US 7,627,916 B1
(45) Date of Patent: Dec. 8, 2009

(54) SKY VIEW PILLOW

(76) Inventor: Virginia P. Gielow, 260 Saddler Rd., Bay Village, OH (US) 44140

( * ) Notice: Subject to any disclaimer, the term of this patent is extended or adjusted under 35 U.S.C. 154(b) by 0 days.

(21) Appl. No.: 12/258,760

(22) Filed: Oct. 27, 2008

(51) Int. Cl.
*A47G 9/00* (2006.01)

(52) U.S. Cl. ..... 5/636; 5/922; 297/393

(58) Field of Classification Search ..... 5/636, 5/640, 922, 644; 297/397, 393
See application file for complete search history.

(56) References Cited

U.S. PATENT DOCUMENTS 1,491,146 A * 4/1924 Larson ..... 297/393
4,951,337 A * 8/1990 Hull et al. ..... 5/636
5,345,633 A * 9/1994 Harnish ..... 5/639
6,435,617 B1 * 8/2002 McNair ..... 297/397
6,484,335 B2 11/2002 Gilbert
D476,517 S * 7/2003 Davis ..... D6/601
D564,807 S * 3/2008 Da Re ..... D6/501
2008/0271249 A1 * 11/2008 Deetsch ..... 5/640
2009/0058161 A1 * 3/2009 Meert ..... 297/397

OTHER PUBLICATIONS

Website: www.marksfishing.com, containing "Chub Bedchair Pillow", reprinted Oct. 24, 2008.
Website: Crazy Carp Angling Centre, containing "Wychwood Fleece Pillow", reprinted Oct. 24, 2008.

* cited by examiner

*Primary Examiner*—Alexander Grosz
(74) *Attorney, Agent, or Firm*—Fay Sharpe LLP

(57) ABSTRACT

Pillows for attachment to a neckstrap are disclosed. Such pillows are particularly suitable for any activity where one's head must be tilted back or involving overhead viewing, such as birdwatching, stargazing, air show viewing, or any other aerial viewing.

4 Claims, 3 Drawing Sheets

SKY VIEW PILLOW

BACKGROUND

The present disclosure relates to pillows used to support a person's head or neck. In particular, the disclosure relates to pillows with fasteners wherein the fasteners may be used to attach a pillow to a neckstrap, such as one on a set of binoculars used for birding, stargazing, air shows, and generally any type of activity involving overhead viewing.

Birding is a popular hobby in the United States and abroad. While birding, a person is often in the same position for prolonged periods of time. Birders must avoid making noises so that they do not scare away birds and so that they can hear birds clearly since some species are easier to identify by their sounds than by their appearance. Birders also often focus their attention upwards. Birders thus spend significant periods of time with their heads tilted back, which can lead to neck and back pain. Other people who spend a lot of time looking up face similar problems.

BRIEF DESCRIPTION

Disclosed, in various embodiments, are pillow apparatuses that can be attached to neckstraps. The pillow apparatuses comprise a pillow unit and a plurality of fastenings straps. The pillow unit is of a generally small size as it is intended mainly to support only the head of one person.

Disclosed in some embodiments is a pillow apparatus comprising a pillow unit and a plurality of fastening straps. The pillow unit has a first pillow edge, a second pillow edge, and two side pillow edges. The fastening straps are attached to the pillow unit along the first pillow edge. The first and second pillow edges each have a length of 10 inches or less. The two side pillow edges each have a length of 6 inches or less.

In some embodiments, the first and second pillow edges each have a length of from about 7 inches to about 8 inches and the two side pillow edges each have a length of from about 3 inches to 6 inches. In others, the first and second pillow edges each have a length of about 7.5 inches; and the two side pillow edges each have a length of about 3.5 inches. In yet others, the first and second pillow edges each have a length of about 7 inches to about 7.5 inches; and the two side pillow edges each have a length of about 4 inches to about 5.5 inches.

The pillow unit may have a front pillow face having a generally rectangular shape. An exterior of the pillow unit can be made from spandex, and the pillow unit can be filled with from about 2 to about 4 ounces of a filler material, such as fiberfill.

The fastening straps can be hook and loop fasteners. The pillow apparatus may have a total of two fastening straps. The two straps can be between 4 and 5 inches apart, or located at least one inch from a side edge.

In other embodiments, a pillow apparatus comprises a pillow unit and two fastening straps. The pillow unit has a top pillow edge, a bottom pillow edge, two side edges, and a generally rectangular front pillow face. The two fastening straps are attached to the top pillow edge and are about 4.25 inches apart. The top pillow edge and bottom pillow edge have a length of about 7.5 inches, and the two side edges each have a length of from about 3.5 inches to about 5.5 inches.

In other embodiments, a pillow apparatus comprises a generally rectangular pillow unit and two hook-and-loop fastening straps. The pillow unit has a spandex exterior, contains fiberfill, and has a length of about 7.5 inches and a height of from about 3.5 inches to about 5.5 inches. The two hook-and-loop fastening straps are symmetrically attached along the length of the pillow unit about 4.25 inches apart from each other.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
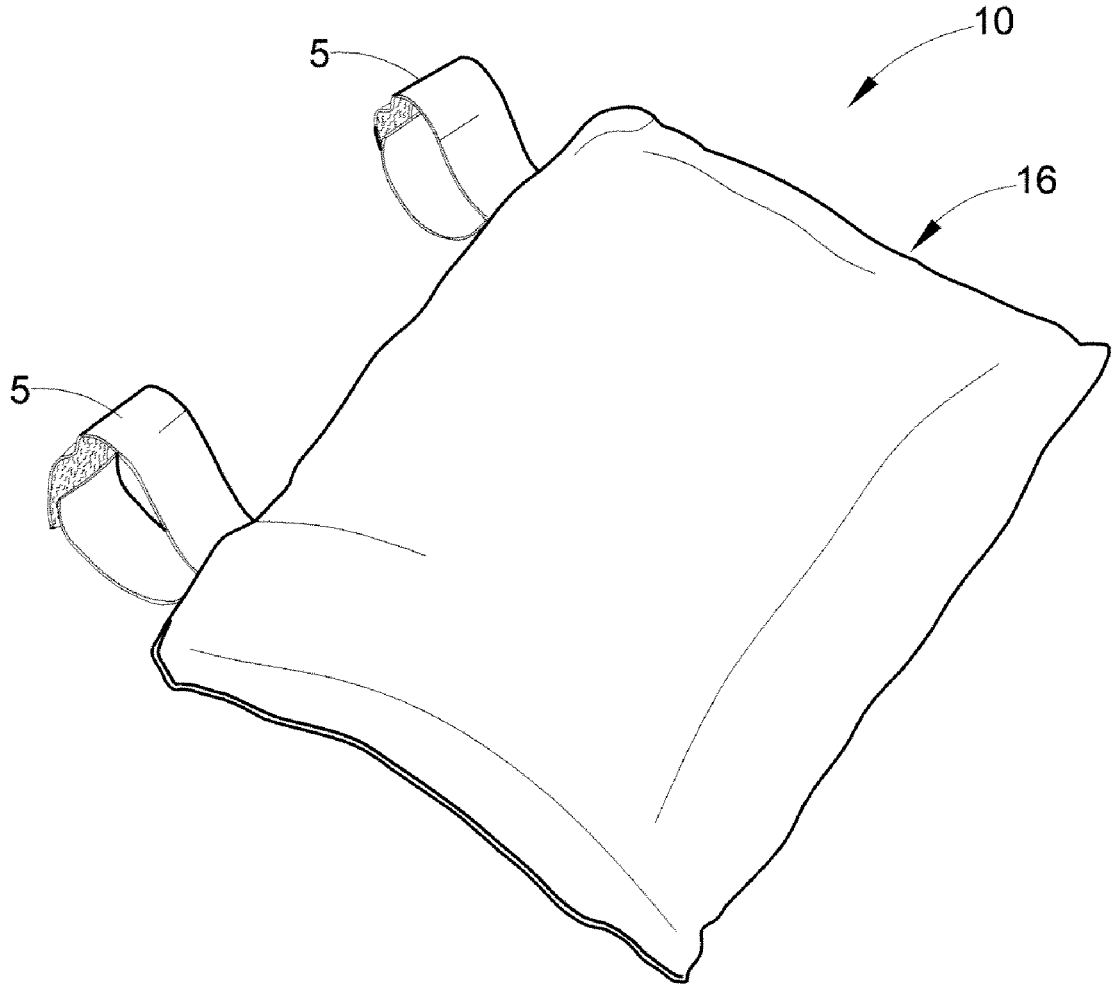
FIG. 1 is a front perspective view of an exemplary pillow apparatus with the fastening straps closed.
Figure 2:
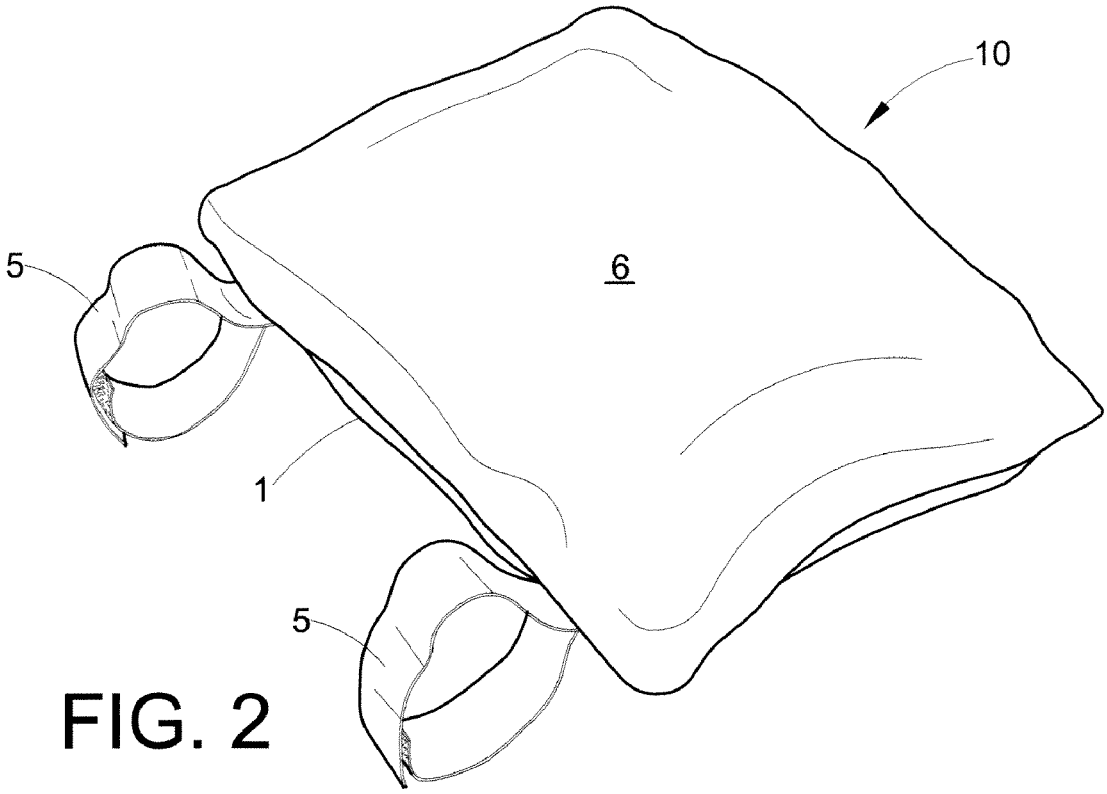
FIG. 2 is a rear perspective view of an exemplary pillow apparatus.
Figure 3:
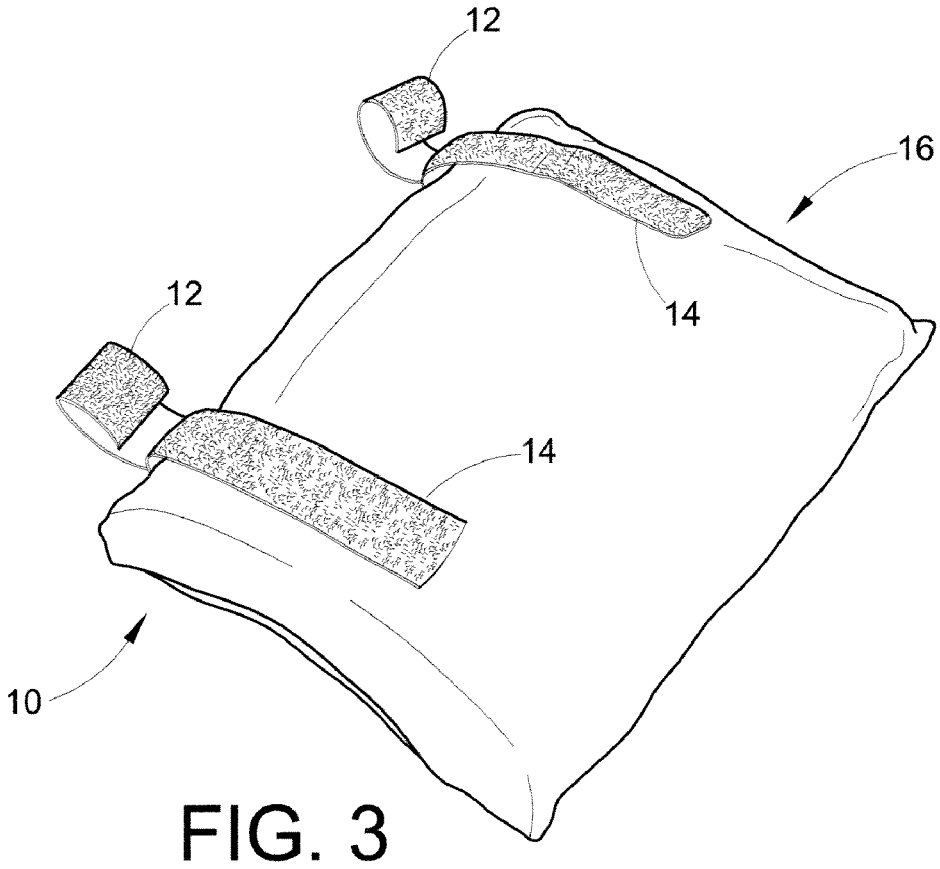
FIG. 3 is a front perspective view of an exemplary pillow apparatus with the fastening straps opened.

A more complete understanding of the apparatuses disclosed herein can be obtained by reference to the accompanying drawings. These figures are merely schematic representations based on convenience and the ease of demonstrating the present disclosure, and are, therefore, not intended to indicate relative size and dimensions of the apparatuses thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

Referring to FIG. 1, the pillow apparatus 10 comprises a pillow unit 16 and a plurality of fastening straps 5. The pillow unit has a first pillow edge or top pillow edge 1, a second pillow edge or bottom pillow edge 2, and two side pillow edges 3, 4. Two fastening straps 5 are shown. The fasteners are attached to the first pillow edge of the pillow unit.

Because the pillow is portable and used by only one person at a time, it has relatively small dimensions. The first pillow edge 1 and second pillow edge 2 each have a length of 10 inches or less, and the two side pillow edges 3, 4 each have a length of 6 inches or less. Alternatively, the first and second pillow edges may be considered the length of the pillow and the two side pillow edges may be considered the height of the pillow. Other larger pillows, such as those having dimensions of 16 inches by 10 inches, are too large to be portable, particularly when supported on the back of one's neck.

In some embodiments, the first and second pillow edges each have a length of from about 7 inches to about 8 inches; and the two side pillow edges each have a length of from about 3 inches to 6 inches.

In further specific embodiments, the first and second pillow edges each have a length of about 7.5 inches; and the two side pillow edges each have a length of about 3.5 inches.

In yet other specific embodiments, the first and second pillow edges each have a length of about 7 inches to about 7.5 inches; and the two side pillow edges each have a length of about 4 inches to about 5.5 inches.

Figure 4:
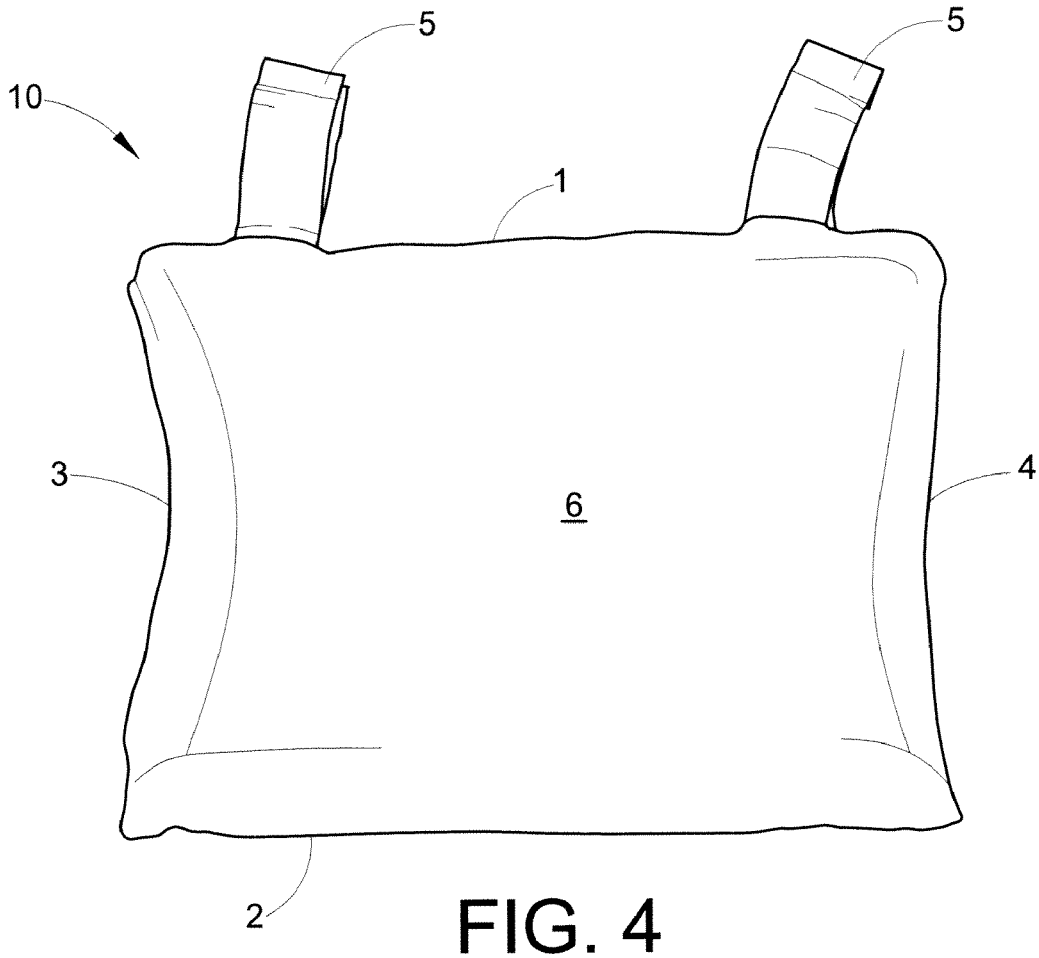
FIG. 4 is a front view of an exemplary pillow apparatus.

As seen in FIG. 4, the pillow unit 12 has a generally rectangular shape, as reflected by the generally rectangular shape of front pillow face 6. However, the pillow unit may have other symmetrical shapes suitable for supporting a person's head. For example, the pillow unit may be trapezoidal.

Figure 5:
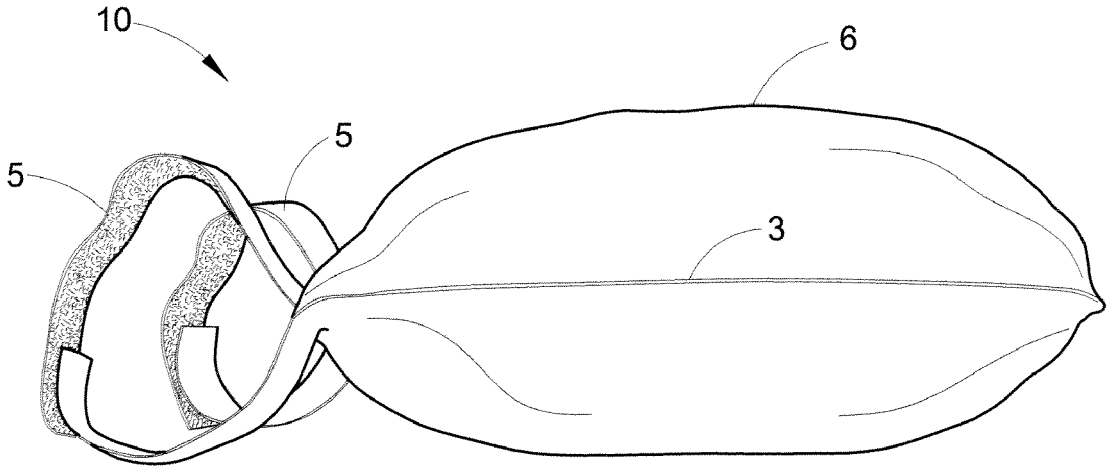
FIG. 5 is a side view of an exemplary pillow apparatus.

As seen in FIG. 5, the pillow unit 12 has a somewhat elliptical shape. This shape can be controlled by changing the amount of filler material inserted into the pillow unit. Typically, the pillow unit is made from an exterior made from any material suitable for outdoor use, such as spandex. Chemically, spandex is a material made from a block copolymer of polyurethane and polyethylene glycol. Spandex is commercially available as Lycra® from Invista Corp. Other stretch fabrics may also be used for the exterior, such as cotton, polyester, fleece, wool, or combinations thereof. From about 2 to about 4 ounces of a filler material, such as fiberfill, are inserted into the exterior. The filler should be high quality and preferably non-allergenic. Any material suitable for use in a pillow, such as polyester, is suitable for the fiberfill. In addition, the exterior and filler should be washable and functional in any type of weather.

The fastening straps 5 are located along the top pillow edge and allow the pillow unit to be attached to anything worn around the neck. For example, the pillow unit could be attached to a camera, binoculars, camera case strap, sunglass strap, eyeglass strap, or even to a necklace, scarf, or bandanna. Some embodiments use exactly 2 fastening straps. The fastening straps may be hook-and-loop fasteners such as Velcro®. The fastening straps are between 4 and 5 inches apart. In some embodiments, the fastening straps are about 4.25 inches apart. Each strap can also be located at least one inch from a side edge. The fastening strap itself is generally about 0.75 inches wide. The hook strap 12 and the loop strap 14 do not need to be identical in length. In some embodiments, the loop strap is longer.

In some specific embodiments, the pillow unit is generally rectangular and has a length of about 7.5 inches and a height of from about 3.5 inches to about 5.5 inches. Two fastening straps are attached along the first pillow edge about 4.25 inches apart and are symmetrically located The pillow apparatus of the present disclosure can be attached to a neckstrap and used to support a user's head when the head is tilted backwards (i.e. so the user can look upwards). This can relieve stress and pain in the neck and back. The pillow apparatus can also be placed between the strap and the neck to cushion the neck area under the strap if desired. The pillow apparatus can also be used as a support for camera equipment in place of a tripod or as an elbow support during photography, as well as cushioning a lens and/or camera in a camera bag, backpack, suitcase, or briefcase. The pillow apparatus can also be "crushed" or "squished" to form a tube, if desired.

The pillow apparatus can be made by methods known in the art. For example, the pillow unit can be made by obtaining a piece of Lycra® that is 8.5 inches by 11 inches. Two 4-inch loop straps and two 3-inch hook straps are provided, each strap being about 0.75 inches wide. A loop strap is paired with a hook strap and tacked together to form a hook-and-loop strap. Each hook-and-loop strap is then sewn along an 8.5-inch edge of the Lycra® piece, about 1.5 inches away from each outside edge (i.e. so the hook-and-loop straps are about 4 inches apart from each other). The Lycra® piece is then folded in half along the 11-inch sides. The three sides are then stitched together approximately one-half inch from the edge, with a small opening of approximately 1 inch left unstitched. The unit is then turned right side out, resulting in a pillow apparatus having a pillow unit of approximate dimensions 7.5 inches×5 inches. The pillow unit is then stuffed with about 2.5 inches through the small opening, and the opening is then stitched closed.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A pillow apparatus, comprising:

a pillow unit comprising a top pillow edge, a bottom pillow edge, two side edges, and a generally rectangular front pillow face; and two fastening straps, each fastening strip comprising a hook strap and a loop strap, the hook strap and the loop strap being attached to the top pillow edge;

wherein the top pillow edge and bottom pillow edge have a length of about 7.5 inches;

wherein the two side edges each have a length of from about 3.5 inches to about 5.5 inches; and wherein the two fasteners are about 4.25 inches apart.

2. A pillow apparatus comprising:

a generally rectangular pillow unit comprising a first pillow edge, a second pillow edge, and two side pillow edges; and;

a plurality of fastening straps;

wherein the first and second pillow edges have a length of about 7.5 inches;

wherein the two side pillow edges have a length of from about 3.5 inches to about 5.5 inches;

wherein the pillow unit comprises a spandex exterior and contains fiberfill; and wherein the plurality of fastening straps comprises two hook-and-loop fastening straps symmetrically attached along the first pillow edge about 4.25 inches apart from each other.

3. A method for using a pillow apparatus comprising:

providing a pillow apparatus comprising:

a pillow unit comprising a first pillow edge, a second pillow edge, and two side pillow edges; and a plurality of fastening straps;

wherein the fastening straps are attached to the pillow unit along the first pillow edge about 4.25 inches apart;

wherein the first and second pillow edges each have a length of about 7.5 inches; and wherein the two side pillow edges each have a length from about 3.5 inches to about 5.5 inches; and attaching the pillow apparatus to an item worn around a person's neck using the fastening straps.

4. The method of claim 3, wherein the item is a camera, binoculars, camera case strap, sunglass strap, eyeglass strap, necklace, scarf, or bandanna.

* * * * *